US009707487B2

(12) United States Patent
Chan et al.

(10) Patent No.: US 9,707,487 B2
(45) Date of Patent: Jul. 18, 2017

(54) TOY FIGURINES WITH SPIN KICK MECHANISM

(71) Applicant: Mattel, Inc., El Segundo, CA (US)

(72) Inventors: Patricia Chan, Redondo Beach, CA (US); Steven D. Ryniker, Torrance, CA (US); Yun Keung Lau, Hong Kong (CN); Wai Hang Shum, Hong Kong (CN)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 14/948,102

(22) Filed: Nov. 20, 2015

(65) Prior Publication Data

US 2017/0144076 A1 May 25, 2017

(51) Int. Cl.
*A63H 3/20* (2006.01)
*A63H 3/46* (2006.01)

(52) U.S. Cl.
CPC ..... *A63H 3/20* (2013.01); *A63H 3/46* (2013.01)

(58) Field of Classification Search
USPC ..... 446/330, 331, 333–336, 353–355, 376, 446/377, 383, 384, 390
See application file for complete search history.

(56) References Cited

U.S. PATENT DOCUMENTS 621,055 A 3/1899 Franklin
653,127 A 7/1900 Wale, Jr.
982,096 A 1/1911 Schoenhut
1,056,570 A 3/1913 Montgomery
1,324,783 A 12/1919 Bain et al.
1,329,958 A 2/1920 Criest
1,329,959 A 2/1920 Criest
1,539,251 A 5/1925 Findlay
1,633,456 A 6/1927 Norberg
2,030,486 A 2/1936 Weiss
2,249,670 A 7/1941 Sidle
2,506,190 A 5/1950 Barnes
2,613,080 A 10/1952 Dow
3,594,942 A 7/1971 Hollingsworth
3,641,702 A 2/1972 Gardel et al.
3,874,112 A 4/1975 Sapkus et al.
3,906,661 A 9/1975 Weiser
(Continued)

FOREIGN PATENT DOCUMENTS

GB 2193651 A 2/1988

*Primary Examiner* — Kurt Fernstrom
(74) *Attorney, Agent, or Firm* — Sheppard, Mullin, Richter & Hampton LLP

(57) ABSTRACT

An articulating toy figurine comprises a body, a member coupled to the body via a shaft and an actuator pivotally coupled to the member. The shaft may comprise opposing first and second ends disposed within the member and body, respectively. The first end may comprise a bevel gear. The actuator may be pivotally coupled to the member to drive a gear assembly disposed in an internal cavity of the member. The gear assembly may be operably coupled to the bevel gear of the shaft to rotate the body around a rotation axis defined by the shaft. The rotation axis defines an angle $\theta_1$ that is less than 90 degrees, preferably 30 degrees to 60 degrees, relative to an axis defined by the member. The actuator may be movable from a first position to a second position to cause the body to rotate 360 degrees around the rotation axis.

20 Claims, 6 Drawing Sheets

(56) References Cited

U.S. PATENT DOCUMENTS 3,911,616 A 10/1975 Pelfrey
3,955,311 A 5/1976 Lyons et al.
3,994,092 A 11/1976 Sapkus et al.
4,031,657 A 6/1977 Crosman et al.
4,085,540 A 4/1978 Jernstrom et al.
4,182,076 A 1/1980 Gay et al.
4,186,518 A 2/1980 Luke
4,217,726 A * 8/1980 Flicker ..... A63H 13/04 446/330
4,244,138 A * 1/1981 Holahan ..... A63H 13/02 446/300
4,457,097 A 7/1984 Miller et al.
4,553,946 A * 11/1985 Miller ..... A63H 3/14 446/327
4,605,382 A * 8/1986 Cook ..... A63H 3/20 446/330
4,623,318 A 11/1986 Tsiknopoulos et al.
5,046,987 A * 9/1991 Djordjevic ..... A63H 13/06 446/336
5,413,517 A * 5/1995 Kamijima ..... A63H 13/12 40/411
5,458,523 A * 10/1995 Aoki ..... A63H 13/06 273/440.1
5,601,471 A 2/1997 Kennedy
5,727,982 A 3/1998 Hurt
5,836,803 A 11/1998 Hamlin
6,012,962 A 1/2000 Arriola
6,022,263 A * 2/2000 Liu ..... A63H 3/20 446/330
6,042,451 A 3/2000 Feldman
6,224,456 B1 * 5/2001 Wittenberg ..... A63H 3/20 446/330
6,280,285 B1 8/2001 Morehouse
6,296,543 B1 10/2001 Andrews
7,192,331 B1 3/2007 Ward
7,338,341 B2 * 3/2008 Hoeting ..... A63H 13/02 446/268
8,932,100 B2 * 1/2015 Saunders ..... A63H 3/20 446/330
2012/0329363 A1 12/2012 Barthold et al.

* cited by examiner

TOY FIGURINES WITH SPIN KICK MECHANISM

FIELD OF THE INVENTION

This invention relates to toy figurines and, more particularly, to toy figurines that have a user-activated mechanism in one limb to actuate the rest of the toy figurine to perform a spin kick.

BACKGROUND

Toy figurines have long been popular among children and even adults. Toy figurines are often poseable and based upon popular characters. The market for toy figurines based on popular characters can be significant.

Toy figurines having limbs with articulated joints are known in the art. The limbs of the toy figurine, however, typically require direct physical manipulation to change the toy figurine's pose, making it difficult to simulate combative movements, such as punching or kicking, which require rapid fire execution to be realistic. Such toy figurines are therefore either impractical or unsatisfactory for play involving simulated combat movements.

While it is desirable for toy figurines to have certain movements, the ability to translate these movements into a toy figurine can be challenging and difficult.

BRIEF SUMMARY

In one embodiment, an articulating toy figurine is provided. The articulating toy may comprise a body, a member coupled to the body via a shaft and an actuator pivotally coupled to the member. The shaft may comprise opposing first and second ends disposed within the member and body, respectively. The first end may comprise a bevel gear. The actuator may be pivotally coupled to the member and configured to drive a gear assembly disposed in an internal cavity of the member. The gear assembly may be operably coupled to the bevel gear of the shaft to rotate the body around a rotation axis defined by the shaft.

In a first optional aspect, the actuator may be configured to drive the gear assembly when it moves from a first position to a second position.

In a second optional aspect, the actuator may be coupled to a clutch that is configured to selectively drive or rotate a first gear of the gear assembly. When the actuator moves from the first position to the second position, the clutch may engage with and rotate the first gear of the gear assembly. When the actuator returns to the first position from the second position under a biasing force of a spring, the clutch may at least partially disengage from the first gear to permit the clutch to at least partially rotate independently of the first gear.

In a third optional aspect, rotation of the first gear may drive a second gear of the gear assembly, the second gear being concentrically coupled to a second bevel gear. The diameter of the second bevel gear may be larger than a diameter of the second gear.

In a fourth optional aspect, the second bevel gear may drive a bevel gear assembly. The bevel gear assembly, in turn, may drive the bevel gear of the shaft.

In a fifth optional aspect, the second end of the shaft may comprise a terminal gear engaging the body and causing the rotation of the body around the rotation axis.

In another embodiment, an articulating toy figurine is provided. The articulating toy figurine may comprise a body, an elongated member coupled to the body along a rotation axis and an actuator disposed from the elongated member. The body may be rotatable around the rotation axis defining an angle $\theta_1$ that is less than 90 degrees relative to an axis defined by the elongated member. The actuator may be biased to a first position and movable to a second position to cause the body to rotate 360 degrees around the rotation axis.

In a first optional aspect, the angle $\theta_1$ is from about 30 degrees to about 60 degrees.

In a second optional aspect, when the actuator is in the first position, the body is in a substantially upright position relative to the elongated member.

In a third optional aspect, the actuator is a lever comprising a first end and a second end. The first end may be coupled to a drive train that actuates the body to rotate the body 360 degrees around the rotation axis and the second end may project outwardly of the elongated member and may comprise a finger grip.

In a further embodiment, an articulating toy figurine is provided. The articulating toy figurine may comprise a body, a plurality of members coupled to the body, a dual-ended gear assembly, and an actuator. The plurality of members comprise a hand-held control limb and the dual-ended gear assembly may couple the body and the control limb along a rotation axis defining an angle $\theta_1$ that is from about 30 degrees to about 60 degrees relative to an axis defined by the control limb. The actuator may be configured to move from a first position to a second position to drive the dual-ended gear assembly to rotate the body around the rotation axis.

In a first optional aspect, the toy figurine may comprise a gear assembly coupling the actuator to the dual-ended gear assembly. The gear assembly may be located within an internal cavity defined by the hand-held control limb.

In a second optional aspect, the actuator may be disposed from the hand-held control limb. The actuator may be a lever that protrudes from the hand-held control member and terminates in a finger grip to permit a user to actuate the lever between the first and second position with a thumb.

In a third optional aspect, at least one of the plurality of members, not including the control limb, may be freely rotatable relative to the body.

In a fourth optional aspect, at least one of the plurality of members may comprise two or more sections coupled by one or more joints.

In a fifth optional aspect, the plurality of members may be selected from the group consisting of: an arm, a leg, a tail, and a head.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Preferred and non-limiting embodiments of the inventions may be more readily understood by referring to the accompanying drawings in which.

Like numerals refer to like parts throughout the several views of the drawings.

DETAILED DESCRIPTION OF THE EXEMPLARY EMBODIMENTS

Specific, non-limiting embodiments of the present invention will now be described with reference to the drawings. It should be understood that such embodiments are by way of example only and merely illustrative of but a small number of embodiments within the scope of the present invention. Various changes and modifications obvious to one skilled in the art to which the present invention pertains are deemed to be within the spirit, scope and contemplation of the present invention as further defined in the appended claims.

Figure 1A:
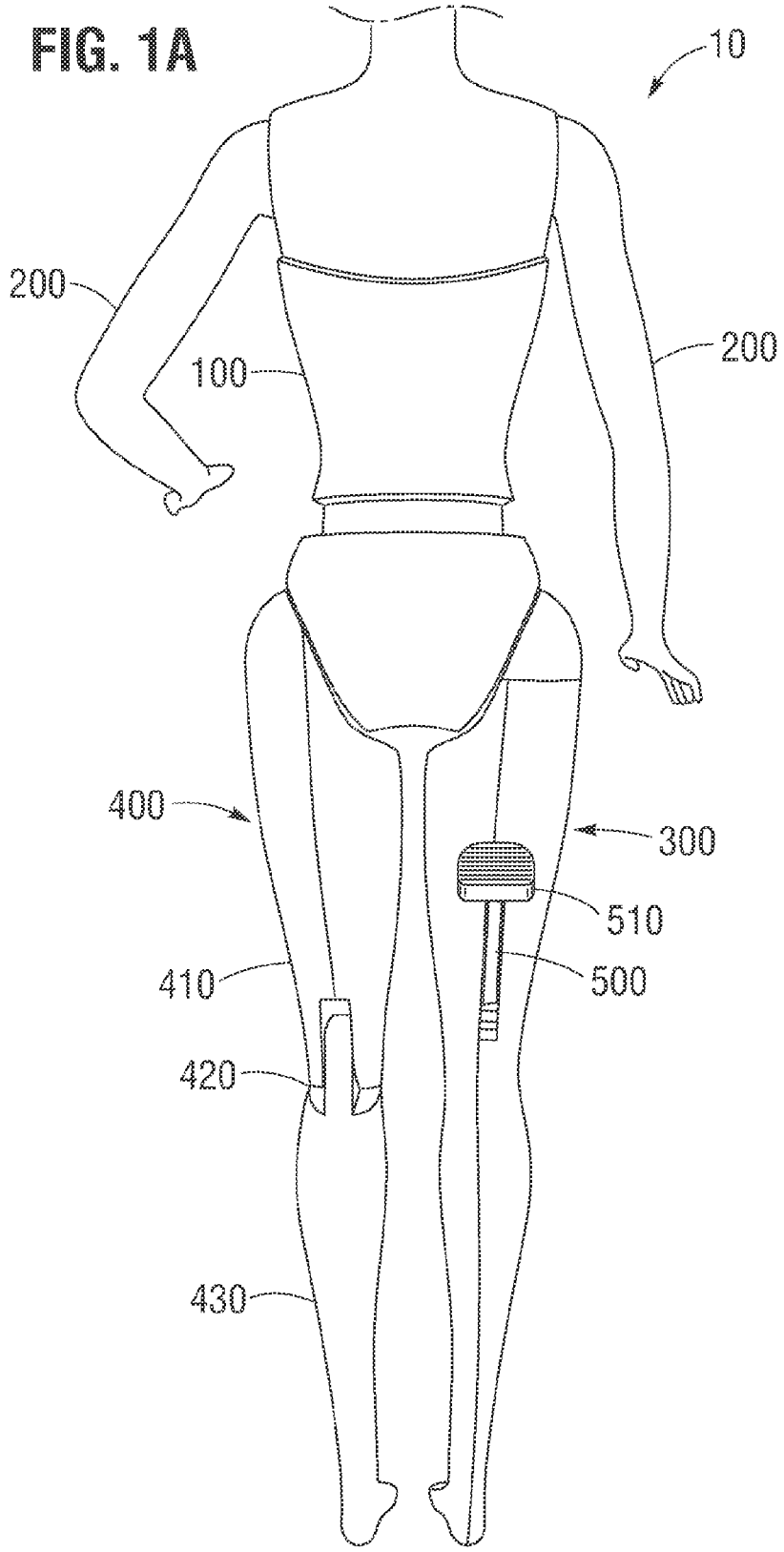
FIG. 1A is a rear view of the articulating toy.
Figure 1B:
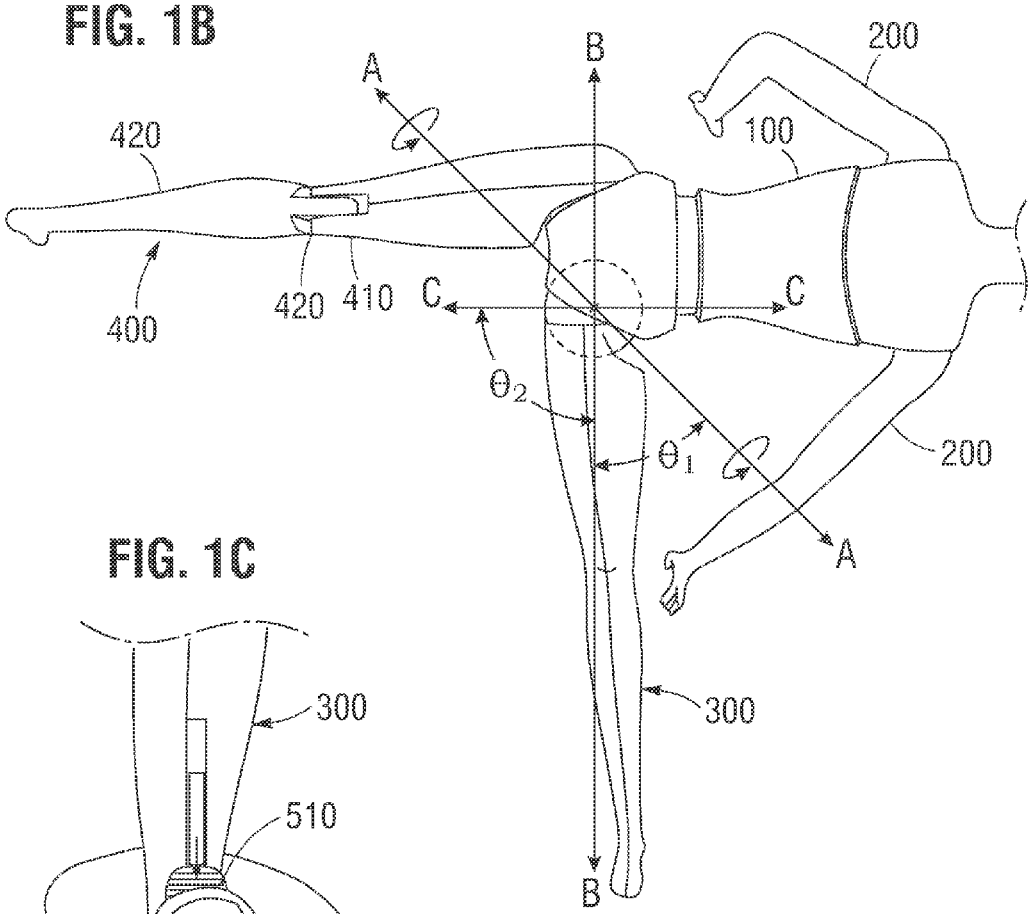
FIG. 1B is a rear view of the articulating toy rotating about the rotation axis A-A. The actuator is omitted from FIG. 1B to more clearly show the various axes.
Figure 1C:
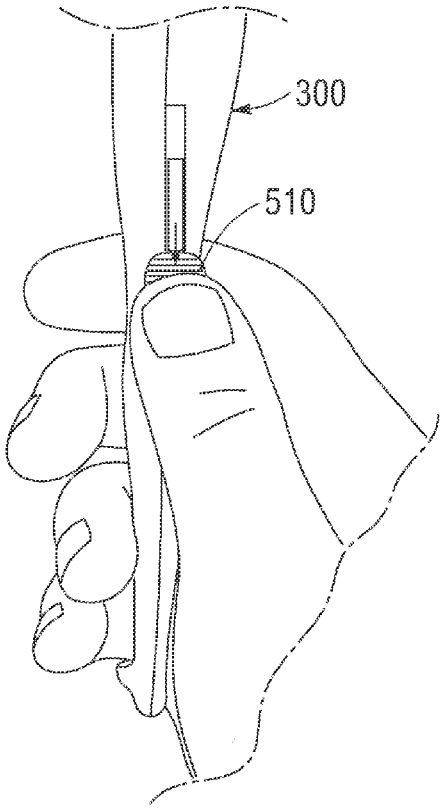
FIG. 1C is a rear view of the actuator in a second position to cause the rotation of the articulating toy as depicted in FIG. 1B.

FIGS. 1A-1C depict an articulating toy figurine 10 that generally comprises a body 100 and a head (see FIGS. 2-3), a pair of arms 200 and a pair of legs 300, 400 coupled to the body 100. In the exemplary embodiment depicted herein, one of the pair of legs 300, 400 is configured as a hand-held leg member 300 that comprises an actuator 500 with a finger grip 510 (see FIG. 1C) to effectuate a movement of the remaining portions of the toy figurine 10 relative to the hand-held leg member 300. The other one of the pair of legs, specifically leg member 400, may be readily movable or posable about a joint coupling comprising a first joint coupling 450A and a second joint coupling 450B. The first joint coupling 450A is attached to the body 100 at one end and coupled to a second joint coupling 450B at the other end. The second joint coupling is attached to the inside of the two half-shells 400A, 400B, which form the upper portion 410 of the leg member 400. The leg member 400 may further comprise a "knee" joint 420 to couple the lower portion 430 of the leg member 400 to the upper portion 410. The joint 420 may permit the lower portion 430 to be freely movable or posable relative to the upper portion 410 formed by the two half-shells 400A, 400B.

As shown in FIGS. 1B and 1C, the articulating toy figurine 10 is configured for movement relative to the hand-held leg member 300. In the non-limiting embodiment depicted herein, the articulating toy figurine 10 performs a spin kick with leg member 400 when the hand-held leg member 300 is gripped in a user's hand and the finger grip 510 of the actuator 500 is depressed from its first raised position (see FIG. 1A) to a second lowered position (see FIG. 1C). When the finger grip 510 is fully depressed, the actuating toy figurine 10 is in the position depicted in FIG. 1B in which the leg member 400 has performed a 180 degree rotation around the rotation axis A-A. As shown in FIG. 1B, the leg member 400 is disposed along an axis C-C at an angle $\theta_2$ of approximately 90 degrees relative to the axis B-B defined by the hand-held leg member 300.

Figure 2:
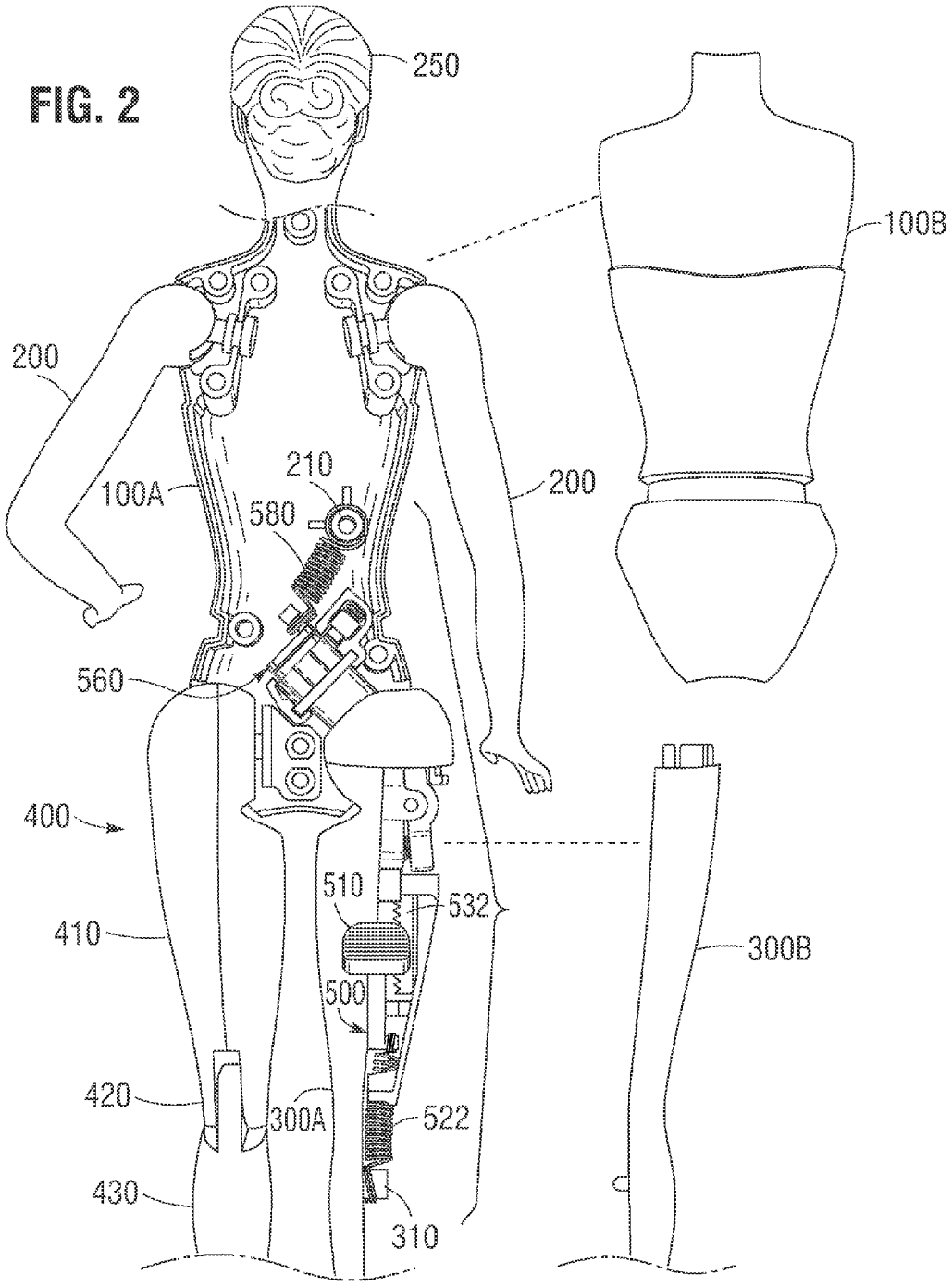
FIG. 2 is an exploded rear view of the articulating toy with the rear body shell and the side leg shell removed to expose the gear assembly.
Figure 3:
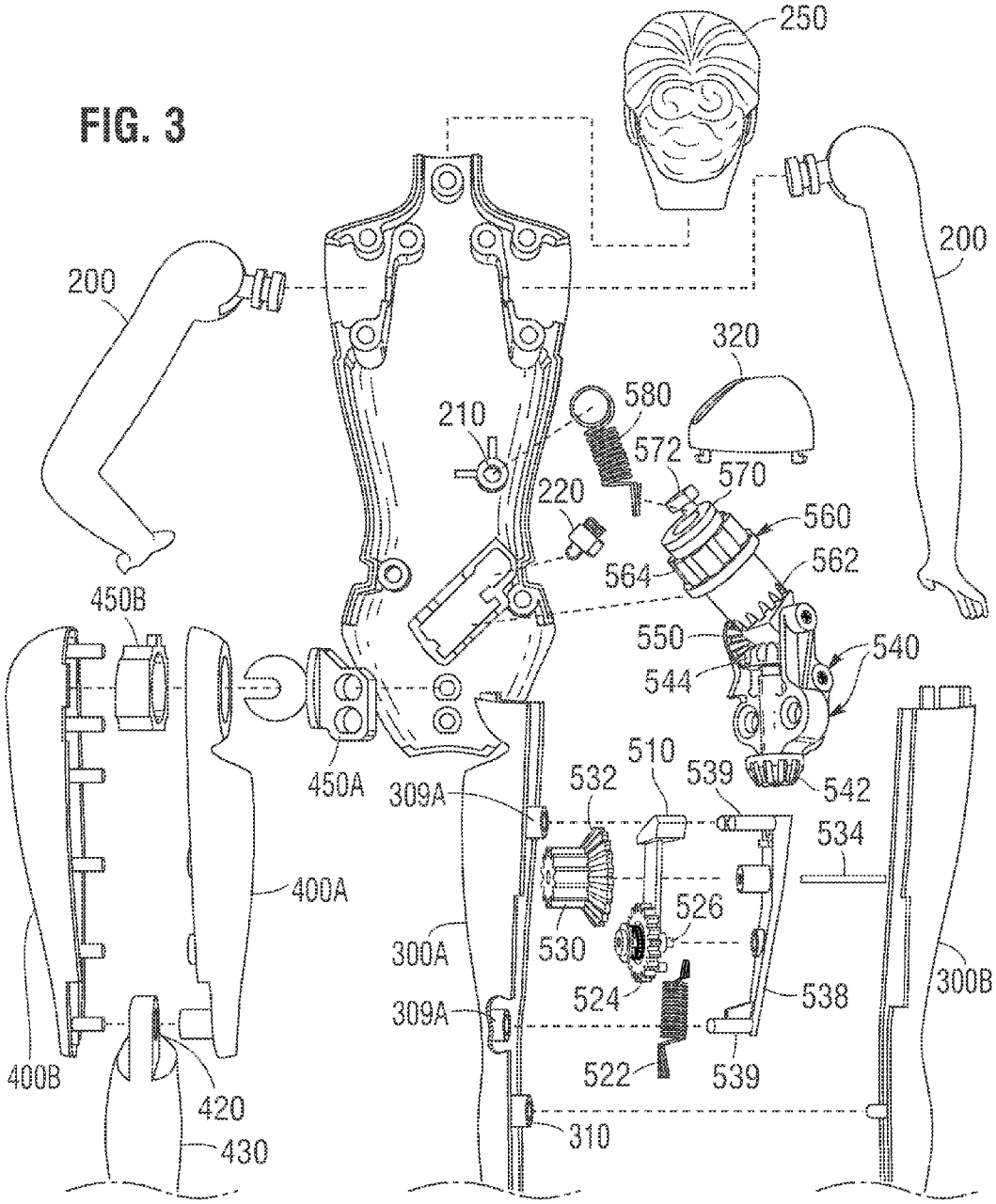
FIG. 3 is an exploded perspective view of the articulating toy.
Figure 4:
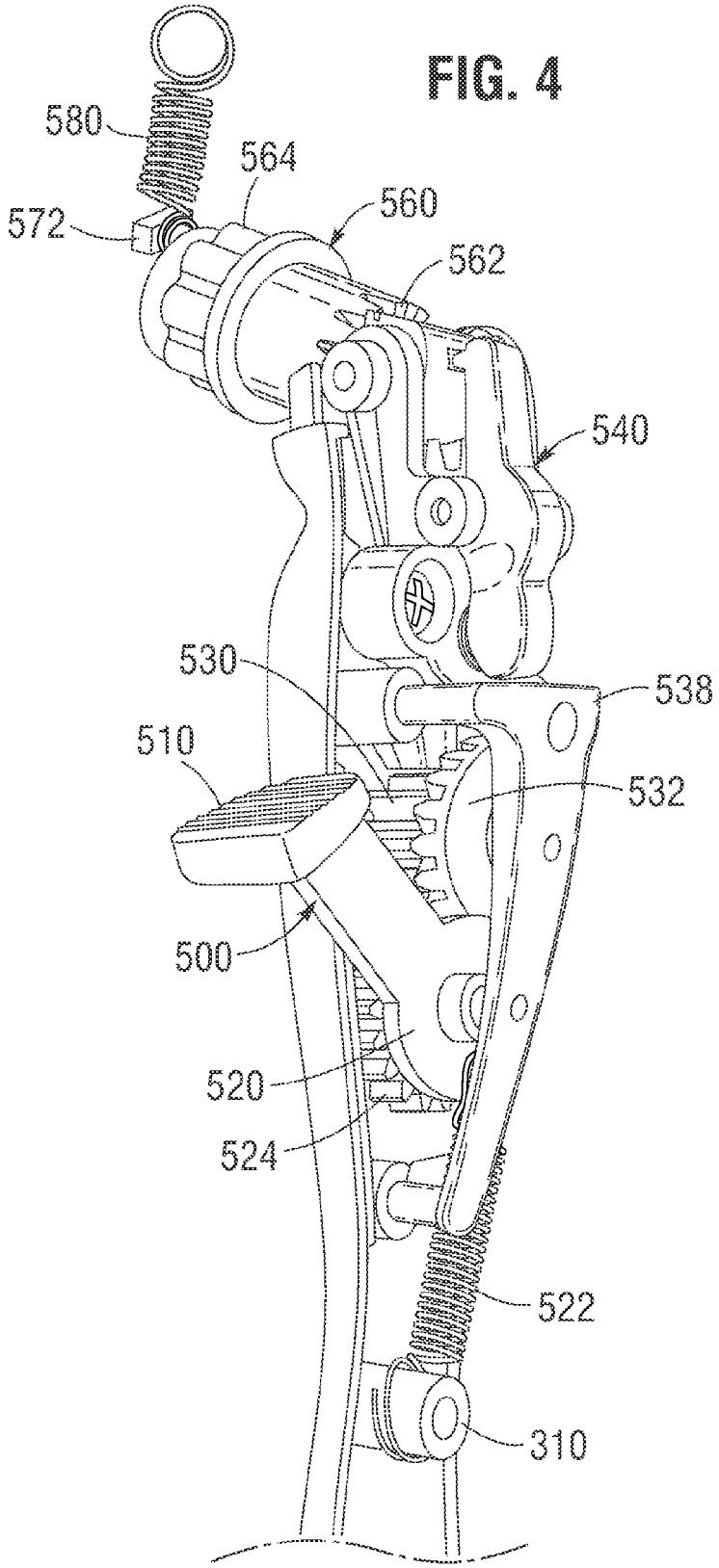
FIG. 4 is a perspective close-up view showing a portion of the gear assembly.
Figure 5:
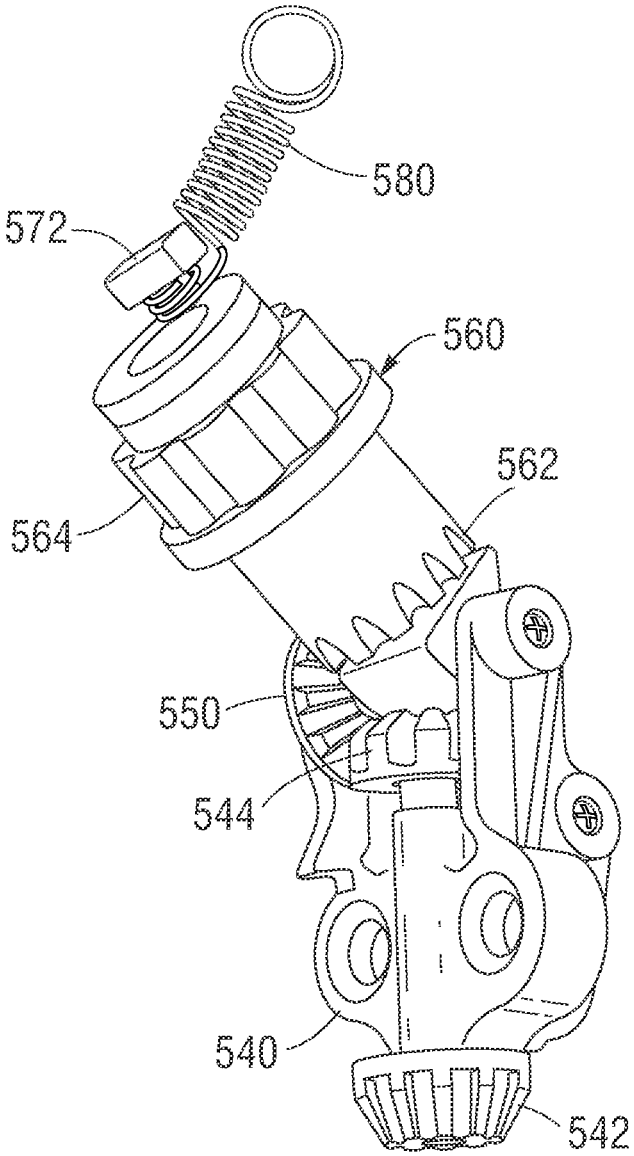
FIG. 5 is a perspective close-up view showing the complete gear assembly including the dual-ended gear assembly coupling the body and the member.

FIGS. 2-5 depict the components of the drive train of the toy figurine 10 that articulates or rotates the body 100 and associated head 250, arms 200 and leg member 400 around the rotation axis A-A (see FIG. 1B) and at an angle $\theta_1$ relative to axis B-B defined by the hand-held leg member 300. As shown in FIGS. 2-3, the body 100 is comprised of a pair of half-shells 100A, 100B and the half-shell 100B is removed to more clearly reveal the arrangement of the components within the internal cavity of the body 100. Similarly, the hand-held leg member 300 is comprised of a pair of half shells 300A, 300B and half shell 300B is removed to more clearly reveal the arrangement of components within the internal cavity of the hand-held leg member 300.

The hand-held leg member 300 comprises an actuator 500 that is configured to drive a gear assembly as the actuator 500 is moved from a first raised position (see FIG. 1A) to a second lowered position (see FIG. 1C). In the embodiment depicted in FIGS. 1A, 1C, 2, 3, and 5, the actuator 500 is a lever having a first end that is coupled to a clutch 520 (see FIG. 4) and a second end that projects outwardly of the hand-held leg member 300 and terminates in a finger grip 510. In another embodiment, the actuator may be a button that can be depressed to drive the gear assembly.

The clutch 520 is configured to selectively engage and rotate a first gear 524 of the gear assembly. In the non-limiting embodiment depicted in FIG. 3, the first gear 524 is a spur gear that is rotatably fixed around an axle 526 that is substantially perpendicular to the axis B-B defined by the hand-held leg member 300. Depressing the finger grip 510 to move the finger grip 510 of the actuator 500 from the first position to the second position rotates the clutch 520 which, in turn, rotates the first gear 524. Either one of the actuator 500 or the clutch 520 may be coupled to a spring 522 attached to a protrusion 310 disposed from the internal cavity of the hand-held leg member 300 to bias the actuator to return to the first position from the second position.

As the actuator 500 returns to the first position under the biasing force of the spring 522, the clutch 520 at least partially disengages from the first gear 524 to permit the clutch 520 to at least partially rotate independently of the first gear 524. In one non-limiting embodiment, the clutch 500 and the first gear 524 may be coaxially or concentrically joined by a ratchet coupling mechanism, in which rotation of the clutch 520 in one direction (i.e., the driving direction from) engages and rotates the first gear 524 in the same direction and rotation of the clutch 520 in the opposing direction at least partially disengages the first gear 524 or does not rotate the first gear 524 in the opposing direction.

Rotation of the first gear 524 as the actuator 500 is moved from the first to the second position drives the rotation of a second gear 530 which is coaxially or concentrically coupled to a bevel gear 532. In the non-limiting embodiment depicted in FIG. 3, the second gear 530 is a spur gear and both the second gear 530 and the bevel gear 532 are rotatably fixed around the same axle 534 that is substantially perpendicular to axis B-B (see FIG. 1B). The second gear 530 and the bevel gear 532 may be formed from or molded as a single piece or they may be separately formed and joined together.

Retaining member 538 may be provided to secure the actuator 500, clutch 520, first gear 524, second gear 530, and bevel gear 532 together between the retaining member 538 and the interior surface of the leg half-shell 300A. The clutch 520 and the first gear 524 are rotatably mounted around a first axle 526 and the second gear 530 and bevel gear 532 are rotatably mounted around a second axle 534. The retaining member 538 further comprises raised protrusions 539 that mates with corresponding recesses 309A in the leg half-shell 300A to secure the components together.

The bevel gear 532 drives a bevel gear assembly 540 which comprises proximal and distal bevel gears 542, 544 on opposing ends of a shaft body. The bevel gear 532 drives the proximal bevel gear 542 which, in turn, drives the distal bevel gear 544. In one embodiment, the proximal and distal bevel gears 542, 544 are coaxially arranged along a shaft axis that is substantially parallel to axis B-B defined by the hand-held leg member 300. This is in contrast to the first and second axles 526, 534 which are substantially perpendicular to axis B-B.

The distal bevel gear 544 drives a dual-ended gear assembly 560 via an intermediate bevel gear 550. The intermediate bevel gear 550 is rotatably mounted on an axle that is substantially perpendicular to axis B-B. The dual-ended gear assembly 560 depicted in FIGS. 3-5 comprises a crown gear 562 in engagement with the intermediate bevel gear 550 and a terminal gear 564 in engagement with a tab 220 disposed in the body 200 such that rotation of the crown gear 562 and therefore the terminal gear 564 operates to rotate the body 200 and associated head 250, arms 200 and leg member 400 around the rotation axis A-A. The dual-ended gear assembly 560 is rotated around an axle along the rotation axis A-A to effectuate the rotation of the body around the rotation axis. The terminal gear 564 may be a spur gear. A spring 580 couples a portion 572 of the dual-ended gear assembly 560 to a protrusion 210 disposed from an internal surface of the body 200 to bias and return the toy figurine 10 to an upright position, as depicted in FIGS. 1A and 2.

In one non-limiting embodiment, the crown gear 562 is disposed substantially within the internal cavity defined by the hand-held leg member 300 and the terminal gear 564 is disposed within the internal cavity of the body 200. As such, the dual-ended gear assembly 560 couples the hand-held leg member 300 and the body 200 together. In order to effectuate a rotation of the body 100 around an axis such that the leg member 400 provides a kick that is substantially perpendicular $\theta_2$ to the axis B-B defined by the hand-held leg member 300, the dual-ended gear assembly 560 or the crown and spur gears 562, 564 are rotatably mounted along an axis A-A that is disposed at an angle $\theta_1$ relative to leg axis B-B.

In one non-limiting embodiment, the angle $\theta_1$ is less than about 90 degrees and is about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees. In another non-limiting embodiment the angle $\theta_1$ is within a range between any two of the foregoing values.

In another non-limiting embodiment, angle $\theta_1$ is selected to provide the desired angle $\theta_2$ of the spin kick of the leg member 400 relative to the leg axis B-B defined by the hand-held leg member 300 when the leg member 400 completes half of the 360 degree rotation around axis A-A. Angle $\theta_2$ may be about 20 degrees, about 25 degrees, about 30 degrees, about 35 degrees, about 40 degrees, about 45 degrees, about 50 degrees, about 55 degrees, about 60 degrees, about 65 degrees, about 70 degrees, about 75 degrees, about 80 degrees, about 85 degrees, about 90 degrees, about 95 degrees, about 100 degrees, about 105 degrees, about 110 degrees, about 115 degrees, about 120 degrees, about 125 degrees, about 130 degrees, about 135 degrees, about 140 degrees, about 145 degrees, about 150 degrees, about 155 degrees, about 160 degrees, about 165 degrees, about 170 degrees, about 175 degrees, and about 180 degrees. In another non-limiting embodiment the angle $\theta_2$ is within a range between any two of the foregoing values.

It is understood that while the articulating toy figurine 10 has been depicted herein as a human figurine with the hand-held control member taking the form of a leg, the articulating toy figurine 10 may take on any number of other forms based on human, non-human, animal or imaginary characters. Moreover, the hand-held control member may be provided with respect to any limb or elongated member that can be grasped with a hand, such as an arm, a tail, a head, or other elongated portion. Moreover, while the actuator 500 has been described as a lever, it is understood that the actuator 500 may also be a push button, a thumb wheel, a pull cord, a switch, or any other structure that is capable of moving from one position to another position and translate that movement to drive the gear assembly.

It is to be understood that the detailed description and specific examples, while indicating preferred embodiments of the present disclosure, are given by way of illustration and not limitation. Many changes and modifications within the scope of the present disclosure may be made without departing from the spirit thereof, and the disclosure includes all such modifications.

The invention claimed is:

1. An articulating toy figurine comprising:

a body;

a member coupled to the body via a shaft, the shaft comprising opposing first and second ends disposed within the member and the body, respectively, the first end comprising a bevel gear; and an actuator pivotally coupled to the member and configured to drive a gear assembly at least partially disposed in an internal cavity of the member, the gear assembly being operatively coupled to the bevel gear of the shaft to rotate the body around a rotation axis defined by the shaft.

2. The articulating toy figurine of claim 1, wherein the actuator is configured to drive the gear assembly when it moves from a first position to a second position.

3. The articulating toy figurine of claim 2, wherein the actuator is coupled to a clutch that is configured to selectively drive or rotate a first gear of the gear assembly.

4. The articulating toy figurine of claim 3, wherein as the actuator moves from the first position to the second position, the clutch engages with and rotates the first gear of the gear assembly.

5. The articulating toy figurine of claim 4, wherein as the actuator returns to the first position from the second position under a biasing force of a spring, the clutch at least partially disengages from the first gear to permit the clutch to at least partially rotate independently of the first gear.

6. The articulating toy figurine of claim 3, wherein rotation of the first gear drives a second gear of the gear assembly, the second gear being concentrically coupled to a second bevel gear.

7. The articulating toy figurine of claim 6, wherein a diameter of the second bevel gear is larger than a diameter of the second gear.

8. The articulating toy figurine of claim 7, wherein the second bevel gear drives a bevel gear assembly.

9. The articulating toy figurine of claim 8, wherein the bevel gear assembly drives the bevel gear of the shaft.

10. The articulating toy figurine of claim 9, wherein second end of the shaft comprises a terminal gear engaging the body and causing the rotation of the body around the rotation axis.

11. An articulating toy figurine comprising:

a body;

an elongated member coupled to the body along a rotation axis, the body being rotatable around the rotation axis and the rotation axis defining an angle $\theta_1$ that is less than 90 degrees relative to an axis defined by the elongated member; and an actuator disposed from the elongated member, the actuator being biased to a first position and movable to a second position to cause the body to rotate 360 degrees around the rotation axis.

12. The articulating toy figurine of claim 11, wherein the angle $\theta_1$ is from 30 degrees to 60 degrees.

13. The articulating toy figurine of claim 11, wherein when the actuator is in the first position, the body is in a substantially upright position relative to the elongated member.

14. The articulating toy figurine of claim 11, wherein the actuator is a lever comprising a first end and a second end, wherein the first end is coupled to a drive train that actuates the body to rotate the body 360 degrees around the rotation axis and wherein the second end projects outwardly of the elongated member and comprising a finger grip.

15. An articulating toy figurine comprising:

a body;

a plurality of members coupled to the body, the plurality of members comprising a hand-held control limb;

a dual-ended gear assembly coupling the body and the control limb along a rotation axis defining an angle $\theta_1$ that is from 30 degrees to 60 degrees relative to an axis defined by the control limb;

an actuator is configured to move from a first position to a second position to drive the dual-ended gear assembly to rotate the body around the rotation axis.

16. The articulating toy figurine of claim 15, further comprising a gear assembly coupling the actuator to the dual-ended gear assembly.

17. The articulating toy figurine of claim 15, wherein the actuator is disposed from the hand-held control limb.

18. The articulating toy figurine of claim 15, wherein at least one of the plurality of members, not including the control limb, are freely rotatable relative to the body.

19. The articulating toy figurine of claim 15, wherein at least one of the plurality of members comprises two or more sections coupled by one or more joints.

20. The articulating toy figurine of claim 15, wherein the plurality of members are selected from the group consisting of: an arm, a leg, a tail, and a head.

* * * * *